US006078033A

United States Patent [19]

Bowers et al.

[11] Patent Number: 6,078,033

[45] Date of Patent: Jun. 20, 2000

[54] MULTI-ZONE INDUCTION HEATING SYSTEM WITH BIDIRECTIONAL SWITCHING NETWORK

[75] Inventors: Thomas J. Bowers, New Berlin, Wis.; Chuck F. Der, Sykesville, Md.; James D. Parker, Brookfield, Wis.

[73] Assignee: Pillar Industries, Inc., Menomonee Falls, Wis.

[21] Appl. No.: 09/086,901

[22] Filed: May 29, 1998

[51] Int. Cl.[7] ..... H05B 6/04

[52] U.S. Cl. ..... 219/662

[58] Field of Search ..... 219/660, 661, 219/662, 671, 656, 663–665; 363/97

[56] References Cited

U.S. PATENT DOCUMENTS

| | | | |
|---|---|---|---|
| 1,981,631 | 11/1934 | Northrup | 219/662 |
| 3,708,645 | 1/1973 | Osborn, Jr. | 219/602 |
| 3,925,633 | 12/1975 | Partridge | 219/10.49 |
| 4,058,696 | 11/1977 | Abtier et al. | 219/662 |
| 4,074,101 | 2/1978 | Kiuchi et al. | 219/601 |
| 4,114,009 | 9/1978 | Kiuchi et al. | 219/622 |
| 4,317,975 | 3/1982 | Mizukawa et al. | 219/662 |
| 4,506,131 | 3/1985 | Boehm et al. | 219/10.77 |
| 4,816,633 | 3/1989 | Mucha et al. | 219/665 |
| 4,845,332 | 7/1989 | Jancosek et al. | 219/602 |
| 5,059,762 | 10/1991 | Simcock | 219/10.77 |
| 5,349,167 | 9/1994 | Simcock | 219/662 |
| 5,892,677 | 4/1999 | Chang | 363/152 |
| 5,909,367 | 6/1999 | Change | 363/163 |

*Primary Examiner*—Teresa Walberg
*Assistant Examiner*—Jeffrey Pwu
*Attorney, Agent, or Firm*—Whyte Hirschboeck Dudek SC

[57] ABSTRACT

An induction heating system having at least one power supply switching network is disclosed to provide selective power control to multiple zones of an induction heating coil to achieve a desired heat distribution in a workpiece. The power supply switching network includes a number of bidirectional switches, each connected in series with one another, and each connected in parallel with a portion, or zone, of an induction heating coil. The bidirectional switches are controlled by a computer that supplies a control signal having a duty cycle as determined by the computer and a multi-zone feedback circuit. By splitting the coils and inserting a switch in parallel with each coil, and each switch in series with one another, the coil is effectively split into multiple series connected coils, thereby being more effectively controllable while avoiding physical alterations to the heating coil. The present invention can therefore compensate for inconsistent characteristics in any particular coil by effectively regulating the power to each section, or zone, thereby regulating the heat applied to the workpiece.

42 Claims, 6 Drawing Sheets

MULTI-ZONE INDUCTION HEATING SYSTEM WITH BIDIRECTIONAL SWITCHING NETWORK

BACKGROUND OF THE INVENTION

The present invention relates generally to induction heating systems, and more particularly to a control system to control the power to multiple zones of an induction heating coil with a bidirectional switching network.

It is well know in the induction heating field that induction heating coils have variable electrical and heating characteristics within a single coil and typically do not provide even heat distribution. Such heating coils are used to apply heat to a workpiece and such variable characteristics of the coil result in uneven heat distribution to the workpiece. It would therefore be desirable to have a system that could control individual sections or zones within a heating coil without having to physically alter the heating coil.

In other applications, certain workpieces require different heat application in different areas. Similarly, it would be desirable to alter the heat output of individual sections, or zones, within a heating coil to heat a workpiece without physically moving the workpiece with respect to the heating coil.

The simplest approach to solving this problem is to connect individual power supplies across each section of the coil. However, such an arrangement creates additional difficulties in that the sections of the coil are magnetically coupled thereby preventing accurate control. Further, magnetically isolating the sections would be expensive and result in high energy losses.

One common approach to solving this problem is to vary the distance between the coil and the workpiece. This has an effect of varying the power in that section by changing the coupling between the workpiece and the coil. However, this approach requires that the equipment be shut down while the necessary physical alterations are made to the coil. Such precise adjustments are strictly by trial and error and can take numerous attempts before the power distribution is correct, resulting in excessive down time and labor.

Therefore, it would be desirable to have an induction heating system with multi-zone control to the coil which does not require physical alteration to the coil or physical movement of the workpiece with respect to the coil that solves that aforementioned problems.

SUMMARY OF THE INVENTION

The present invention provides a system and method of providing individual power control to multiple sections or zones of an induction heating coil that overcomes the aforementioned problems. The present invention can therefore adequately control the amount of heat applied to a particular workpiece irrespective of irregularities in an induction heating coil.

The present invention includes a method of providing individual power control to multiple sections of an induction heating coil which includes tapping the coils of the induction heating coil into at least two sections or zones. In accordance with the present invention, the coil need not be physically altered, but only tapped such that a bidirectional switch can be inserted in parallel with each of the coil zones to allow a current bypass path around each of the zones such that power and heat output are regulated for each individual zone. This allows for more precise control of the amount of heat induced into different areas of the workpiece. This is particularly advantageous in induction heating applications where different areas of the same workpiece require different amounts of heat, or where inconsistencies and coil construction prevent even heat distribution.

In accordance with another aspect of the invention, a power supply switching network is disclosed to provide selective power control to multiple zones of an induction heating coil having a bidirectional switch connected in parallel with a portion of the induction heating coil to thereby define a coil zone. Any number of bidirectional switches can be connected in parallel to define any number of desired zones, depending upon the precision of heat control desired and cost factors. Each of the bidirectional switches are connected in series with one another, and the coil zones are each maintained in series wherein no physical change to a standard coil is needed. A control processor is connected to each of the bidirectional switches to supply a control signal thereto. The control signal having a duty cycle for each of the bidirectional switches to thereby regulate power to each individual heating zone. The power supply switching network of the present invention is connectable between a single main power supply and a physically unaltered induction heating coil to provide selective heat output from each of the induction heating coil zones.

In accordance with another aspect of the invention, an induction heating apparatus is disclosed for providing controlled heat distribution to a workpiece having multiple induction heating coils connected in parallel with the main power supply. Multiple switching networks, according to the present invention, are connected in series with each induction heating coil. Within each of the switching networks, a plurality of series connected bidirectional switches are connected in parallel with the induction heating coil, thereby dividing that section into individual series connected zones that are individually controllable by a microprocessor, or computer. The processor is connected to each of the bidirectional switches of the switching network to selectively switch each switch between an ON state and an OFF state to either direct current through the coil zone, or bypass the current away from the coil zone based on a pulse width modulating method that distributes ON times to reduce the overall power output of the main power supply.

The overall power required under the present invention is controlled by controlling the duty cycle of each switch which results in several advantages to such an arrangement. For example, the power in each section can be controlled using one switch assembly per section of coil without the need of a circuit common. Another advantage includes that only a single bank of tuning capacitors is necessary with this method, and yet another advantage is that the switch and coil assembly can be located away from the tank capacitors due to the existence of a large inductance in series with the heating coil.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1A:
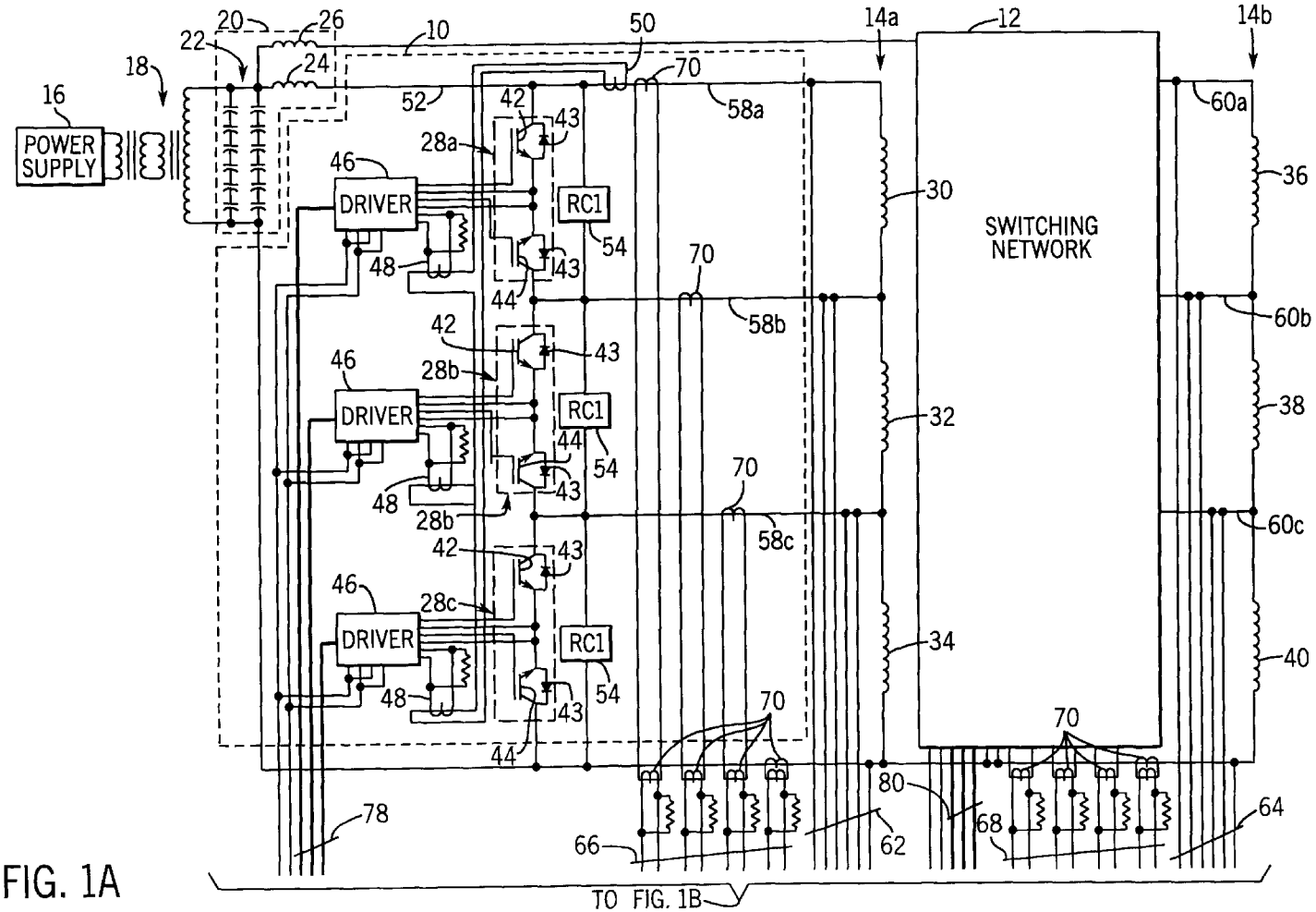
FIGS. 1A–1B is a circuit schematic of a system incorporating the present invention.

Referring to FIG. 1, a detailed circuit schematic of a system in accordance with the present invention is shown, including a pair of power supply switching networks 10 and 12 which provide selective power control to multiple zones of an induction heating coil 14. Switching network 10 and 12 are identical, and therefore switching network 12 is shown in block diagram form for simplicity. In this particular embodiment, the induction heating coil 14 is sectioned into two half-sections 14A, 14B, one section being the lower half, and the other, the upper half. However, the invention is applicable to a single coil section, or to any number of additional sections. The switching networks 10, 12 are connected to a single power supply 16 through a transformer 18 and a power storage or tank unit 20. The power storage unit contains a bank of power factor correction capacitors 22 and a pair of relatively large inductors 24, 26, which are sized to provide a constant current to each active zone of the multi-zone induction heating coil 14. The bank of power factor correction caps 22 also function to maintain a consistent operating frequency.

The series connected inductors 24, 26 are sized large enough to supply essentially a constant current to the induction heating coil 14 and switching networks 10, 12. There is a trade off in the size of the series inductors 24, 26 in that the larger the inductor, the higher the voltage requirement of the tuning capacitors 22 which increases the overall cost of the system, while an undersized inductor will create a dithering of the resonant frequency as the switches 28 are cycled. For cost effectiveness, it is therefore desirable to determine the smallest inductor that will maintain the resonant frequency. In a preferred embodiment, a value of 10 times the inductance of the induction heating coil 14 was adequate to provide essentially a constant current and maintain the resonant frequency stable as the switches 28 are cycled.

Each switching network 10, 12 has a number of bidirectional switches 28*a*, 28*b*, and 28*c* each connected in parallel with a portion of the induction heating coil 14 to thereby define a number of series connected induction heating coil zones 30, 32, 34 and 36, 38, 40. Within each switching network 10, 12, each of the bidirectional switches 28 are connected in series with one another. Each of the bidirectional switches 28*a*, 28*b*, and 28*c* of switching networks 10 or 12, has a pair of back-to-back, series connected switches 42, 44, which are preferably Insulated Gate Bipolar Transistors (IGBTs), but could be any bidirectional semiconductor switch properly rated for the particular application. Each of the semiconductor switches 42, 44 have a reversed biased diode 43 to allow a current path when the other associated semiconductor switch is ON to provide a current path away from the respective induction heating coil zones 30–40. In the preferred embodiment, IGBTs were chosen because of a desired operating frequency of 50 kHz and a current rating of over 1000 amps. At lower current levels, MOSFETS would be acceptable, and at lower operating frequencies, SCRs would be well suited. Similarly, for extremely slow cycling, one could also use simple relays for the bidirectional switches 28. One skilled in the art will recognize that other equivalent switching means can be substituted depending upon application requirements.

Each bidirectional switch 28 is connected to an associated dual gate driver 46, each having a respective current sensor 48 connected to a primary current sensor 50 in operable association with the power supply feed line 52 for tracking current and voltage levels through the induction heating coils 30–34. These current sensors 48, 50 enable the drivers 46 to switch the IGBTs 42, 44 at zero voltage crossing to prevent high switch losses. As one skilled in the art will readily recognize, such zero voltage switching would not be necessary if semiconductor switches having more ideal switching characteristics were used. In accordance with the zero voltage switching of the preferred embodiment, each of the bidirectional switches 28 and series connected induction heating zones 30, 32, and 34 have an RC snubber circuit 54 connected in parallel therewith. The snubber circuits 54 are commonly known RC circuits for suppressing voltage spikes during the switching at the zero cross-over.

Figure 1B:
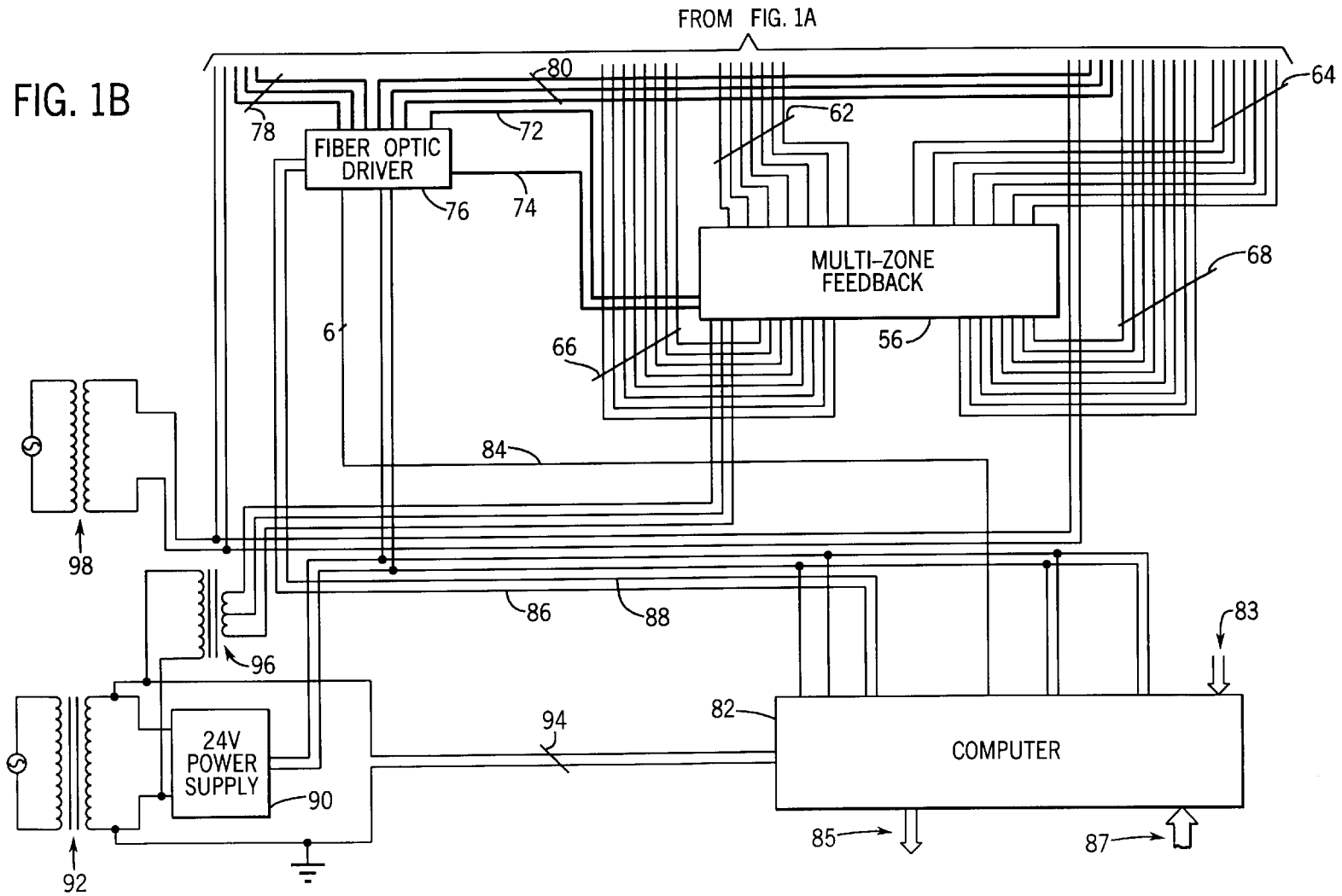

Referring to FIG. 1B a multi-zone feedback circuit 56 is connected to each leg 58*a*, 58*b*, 58*c* and 60*a*, 60*b*, and 60*c* of each zone of the induction heating coil 14. The multi-zone feedback circuitry 56 monitors voltage levels of each of the zones 30–40 via voltage lines 62, 64 and senses current via current lines 66, 68 through associated current sensors 70. The multi-zone feedback circuit 56 provides multi-zone feedback to sense a fault condition on power supply legs 58, 60 within any of the zones 30–40 of the induction heating coil 14, and based on any detected fault, can interrupt or cause switching of any particular bidirectional switch 28 within the switching networks 10, 12. The multi-zone feedback circuit 56 performs a voltage comparison between each leg to protect the bidirectional switches 28 from an over-voltage condition and can also monitor total power in each zone. The multi-zone feedback will set a fault condition if excess voltage is detected and also performs a voltage zero-crossing detection function to perform switching of the bidirectional switches 28 only during zero-crossing points, as previously described with respect to the preferred embodiment. Accordingly, a sync line 72 and a fault line 74 are provided between the multi-zone feedback circuitry 56 and a fiber optic driver 76 to provide synchronous switching of the bidirectional switches 28 with the voltage zero-crossing points, and interrupt or enable switching during a fault, respectively.

The fiber optic driver 76 has fiber optic cables 78, 80 connected to and providing driving signals to each of the dual gate drivers 46 within the switching networks 10 and 12. The fiber optic driver 76 provides isolation between the high voltage associated with the induction heating coil 14 and the driving logic controls. The fiber optic driver 76 is connected to a computer 82 containing a processing unit which produces control signals to each of the bidirectional switches 28 through the fiber optic driver 76 and the dual gate drivers 46. The computer 82 provides the control signals on six control lines 84 to the fiber optic driver 76, as well as providing fault and synchronous signals on a fault line 86 and a sync line 88, respectively. A 24 volt power supply 90 provides 24 volt power to the fiber optic driver 76 and to internal relays in the computer 82. Transformer 92 not only provides AC power to the 24 volt power supply 90, but also supplies 110 AC power to an internal power supply in computer 82 via power supply lines 94 and to a 36 volt current transformer 96 to supply power to the multi-zone feedback circuitry 56. Transformer 98 provides power to each of the dual gate drivers 46.

Inputs 83 to computer 82 are received from an external control system for receiving a start signal for initializing the system. Output leads 85 of computer 82 are input to the main power supply 16 and are used to determine the power level of the power supply output. Inputs 87 are the zone reference control signals, which in the preferred embodiment, are 6 inputs from 6 separate temperature sensors that are placed in operative association with each coil zone 30–40 of the induction heating coil 14. These control signals 87 provide a closed loop feedback system to control the power to each individual zone. If the temperature is not high enough, as determined from inputs 87, the duty cycles are increased and/or the power supply power is increased via output 85 until the desired temperature is reached.

The power in each zone 30–40 of the induction heating coil 14 is enabled when the bidirectional switch 28 is OFF. Conversely, turning the switch to the ON state, shorts out that particular zone of the coil and the power in that section drops. The power output of any one of the particular zones 30–40 is then controlled by controlling the duty cycle of each particular switch 28. In a preferred embodiment, in order to provide even heating to a workpiece, it is important to cycle through the switches 28 rapidly enough so that the power supply 16 can be sized to merely respond to the average power. In this arrangement, each zone of the coil operates at approximately the same current. By cycling through the switches at a much faster rate than the response of the power supply, the power supply will run at the average total power. If the cycling rate were too low, the power supply can become unstable. The maximum cycling rate is then determined by the frequency selected for the coil.

As is now evident, the overall function of the present invention is to provide a stable AC current out of the tank section 20 and direct it either through the induction heating coil zones 30–40, or through the bidirectional switches 28, and thereby bypassing any particular zone of the heating coil 14. In the preferred embodiment, when an IGBT, across any particular coil zone is gated ON, the current flows around the coil section and through that IGBT 42 or 44, and through the other IGBT's associated diode 43 to thereby reduce the power in that zone. When the IGBT's across a given zone are gated OFF, the current is directed through the coil and the power is increased in that zone. The switching networks 10, 12 are designed to be capable of turning ON and OFF for each half cycle.

The system uses 1,000 cycles as a base for all duty cycle calculations. The required total overall current and the individual duty cycles are calculated for each zone by computer 82. The power supply is then ramped up or down to the correct current level and the duty cycles are set accordingly. Each bidirectional switch 28 will then switch a number of times based on the duty cycle multiplied by the base 1,000 cycles. The computer control is designed to maximize the cycling rate at any given duty cycle to stabilize the power supply and reduce the mechanical stresses on the coil. This is accomplished by spacing the ON pulses across 100 subsections of the 1,000 pulse base, and each of the subsections has 10 cycles of tank current, as will be further described with reference to FIG. 4. The software program optimizes this procedure by evenly distributing the ON pulses in the subsections. As an example, if the duty cycle called for a 25% ON time, then the total cycles would be 250 out of 1,000, and half of the subsections would be gated ON for 2 cycles and gated OFF for 8 cycles, and the other half would be gated ON for 3 cycles and OFF for 7 cycles. Therefore, in the 100 subsections of the 1,000 pulse base, the total cycles would be (50×2)+(50×3), or a total of 250 cycles. If the duty cycle were increased under this optimization procedure, first, each of the subcycles with 2 pulses would be increased to 3, before any of the subcycles with 3 pulses were increased to 4. Therefore, the ultimate cycling rate is 5 kHz, as opposed to 50 Hz. By spreading the ON pulses across a 1,000 cycle band, not only is the apparent cycling rate kept high, the system resolution is also increased to 1/1,000.

Figure 2A:
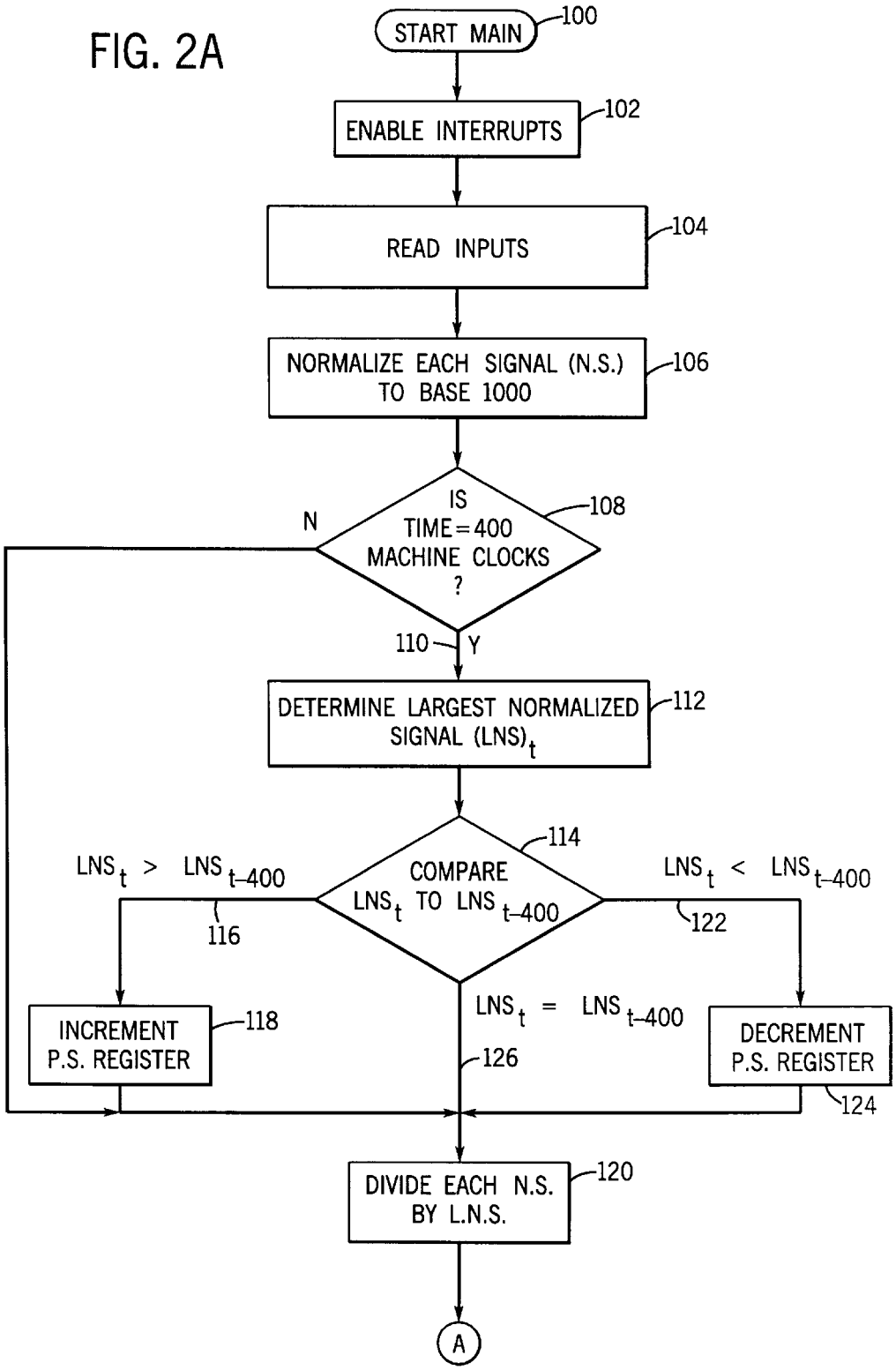
FIGS. 2A–2B is an overall flowchart for implementing a portion of the system of FIGS. 1A–1B.
Figure 2B:
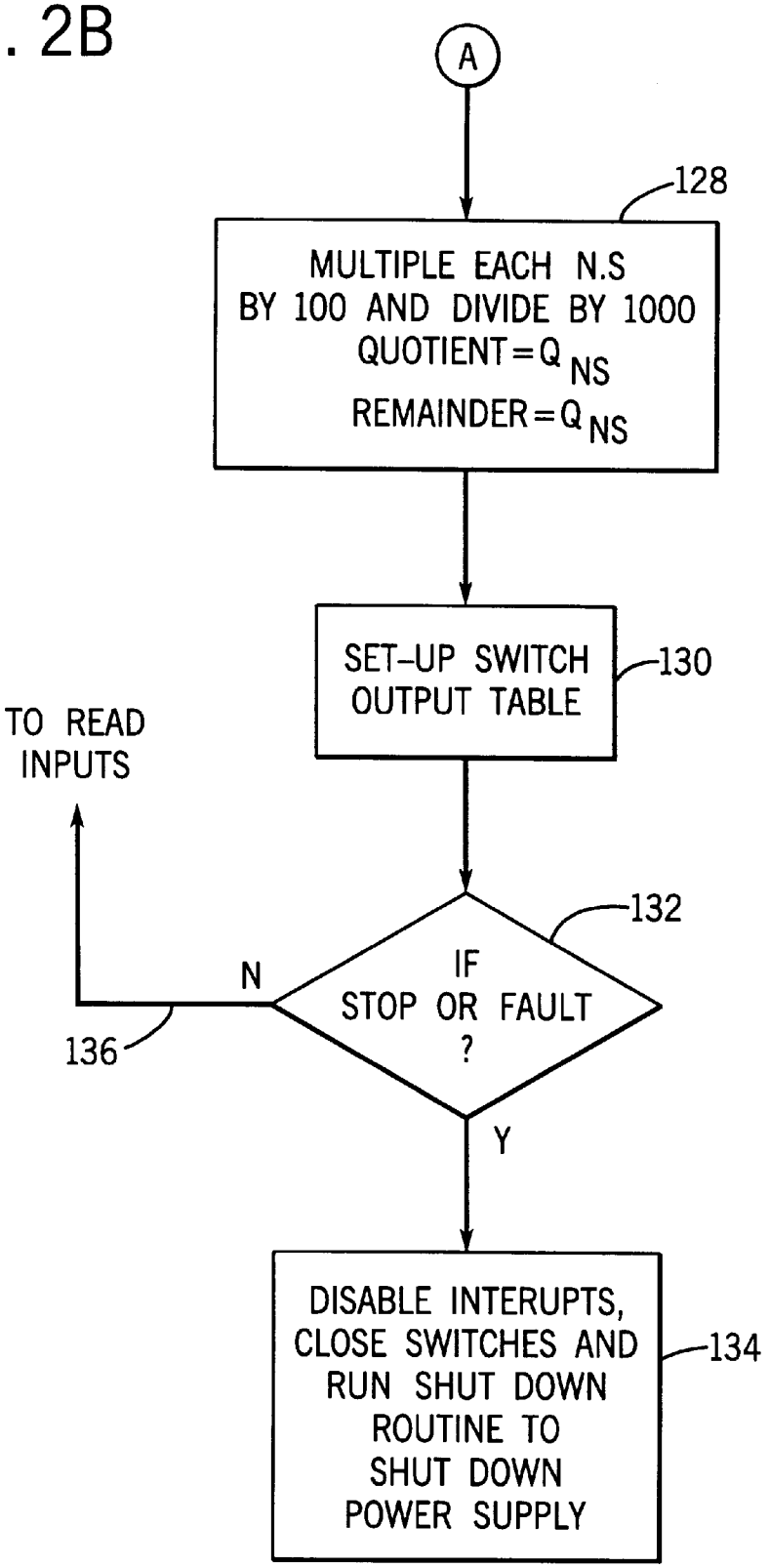

The following algorithm, as described with reference to FIGS. 2A–2B describes a system according to the present invention for creating a modulation, as previously described, in 100 periods at 1/10 the frequency, or over a base total of 1,000 sections. In addition, the algorithm phase shifts the individual zone modulations by 1/200 of the base frequency with respect to each of the other zones. This phase shift provides an additional phase margin in the protection scheme for the frequency stability of the tank section. At these preferred switching rates, the time constant of the tank section is relatively unaffected and remains generally constant and within 1% of its base value. Referring to FIG. 2A, upon power up at 100, the system interrupts are enabled at 102, which will be further described with reference to FIG. 3. The next step in the algorithm of the computer software program is to read the temperature feedback inputs 87, FIG. 1B, at 104, FIG. 2A. Each signal input is then normalized to a base of 1,000 at 106 and a clocked loop begins at 108. As long as the time has not expired 110, the largest of the normalized signals is determined at 112 and compared to the largest normalized signal during a previous iteration 114. When the latest largest normalized signal is greater than the largest normalized signal on the last iteration 116, the power supply register is incremented at 118 and each normalized signal is divided by that last largest normalized signal 120. If however, the latest largest normalized signal is less than the last largest signal 122, the power supply register is decremented to decrease the power to the power supply at 124, or if the largest normalized signals are the same 126, then each of the normalized signals is divided by the largest normalized signal at 120. Then, as continued on FIG. 2B, the algorithm multiplies each of the normalized signals by 100 and divides the results by 1,000 to calculate the duty cycles by finding the quotient $Q_{ns}$ and remainder $R_{ns}$ for each normalized signal at 128. After which, a look up table is produced for the bidirectional switch outputs at 130 and a check is made to see if the computer has received a stop or fault signal 132, and if so, the interrupts are disabled, each of the bidirectional switches are closed, and a shutdown routine is run to bring the power supply down at 134. If no stop or fault is detected at 132, then the system proceeds through path 136 to perform another iteration beginning with reading the inputs at 104. The quotient $Q_{ns}$ and the remainder $R_{ns}$ are used in distributing the ON times over the 100 subsections. The $Q_{ns}$ is evenly distributed, and the $R_{ns}$ is periodically distributed throughout the 100 subsections.

Figure 3:
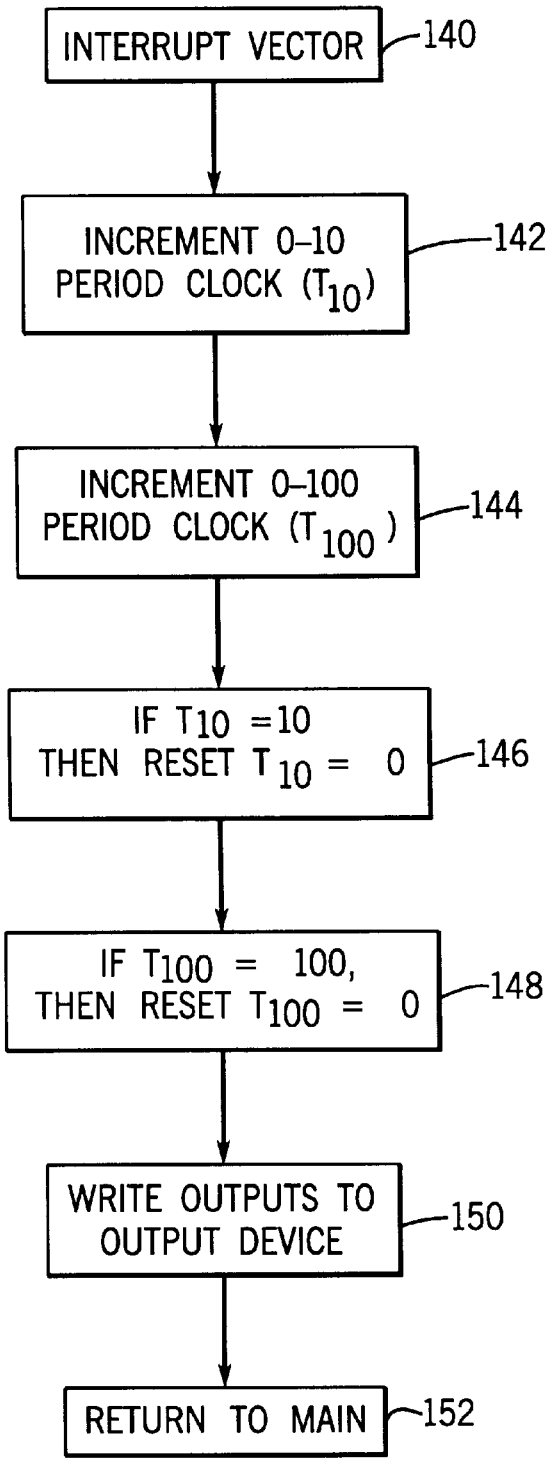
FIG. 3 is a flowchart showing a portion of FIGS. 2A–B in more detail.

Referring to FIG. 3, a custom interrupt handler is initiated at 140 because of the need of quicker interrupts than normally provided in standard computers. Two internal machine clocks are generated, one to track the aforementioned 100 periods $T_{100}$ and one to track the 10 subperiods $T_{10}$. Once the interrupt handler is initiated 140, the period clocks $T_{10}$ and $T_{100}$ are each incremented 142, 144 and if either clock has reached its maximum, it is reset at 146, 148. The quotient $Q_{ns}$ is evenly distributed over the 100 subsections, and the remainder $R_{ns}$ is periodically distributed over the 100 periods for even average distribution of ON times. The outputs are then updated. One output, the power level, is written from the power supply register to a power supply interface to control the main power supply 150, and the individual switch control outputs are updated by pointing to an output table created by the main algorithm as previously described. The interrupt is generated by the frequency of the tank circuit 20 and allows synchronous control of the switching. Upon completion of the updates, the system returns 152 to the main algorithm 100 of FIG. 2A.

Figure 4:
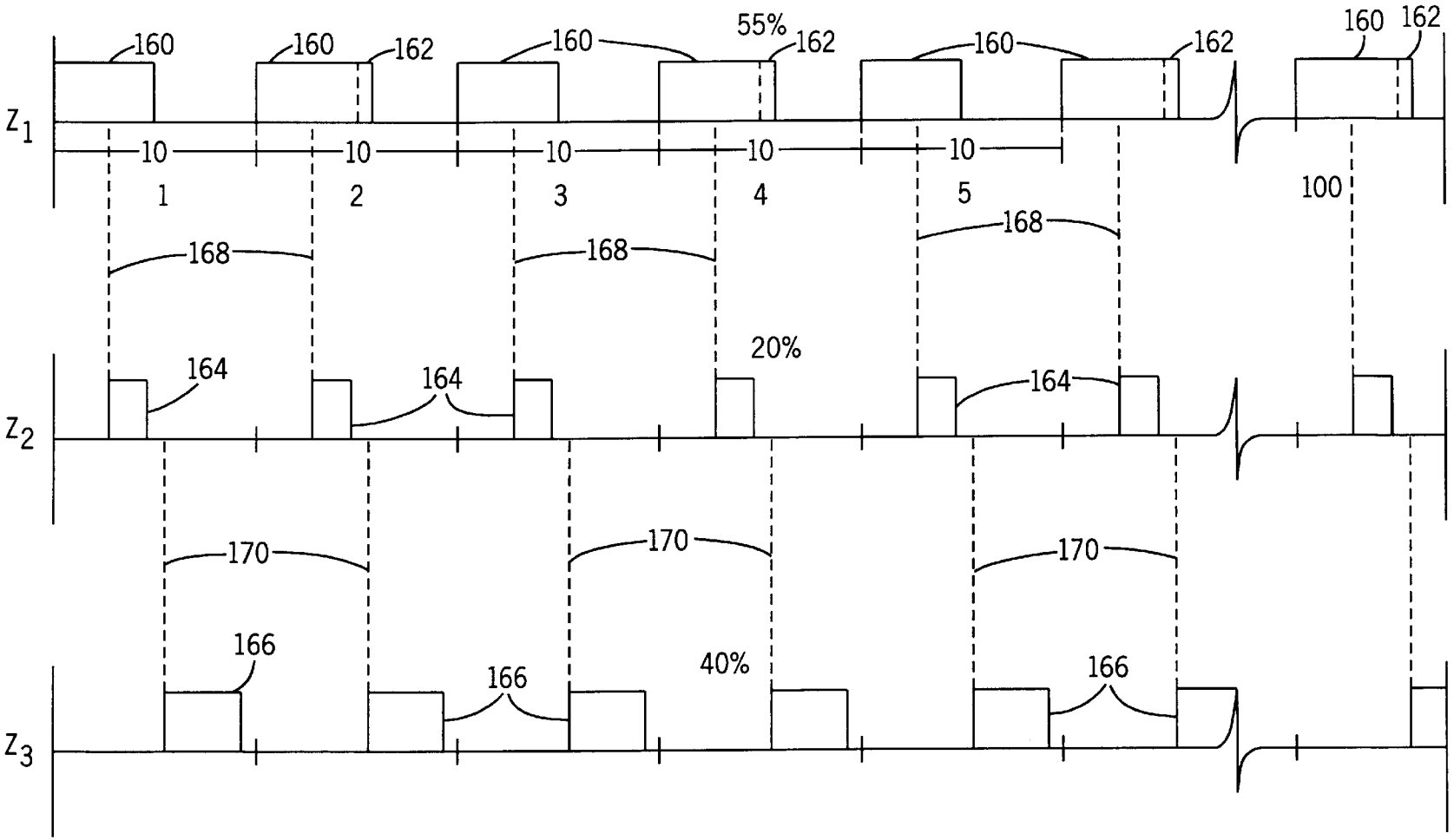
FIG. 4 is a timing diagram showing an example of the implementation of a system in accordance with FIGS. 1*a–b*.

Referring now to FIG. 4, an example of ON time distribution is shown in timing diagram form. The first zone $Z_1$ is shown having a 55% duty cycle. In 1,000 cycles, a 55% duty cycle multiplied by 100 and divided by 1,000 provides a quotient of 5 and a remainder of 5. As shown if FIG. 4, zone 1 is ON for 5 clocks 160 for each of the 100 periods. The remainder 162 is distributed throughout the 100 periods to create an even total average. The timing diagram also shows ON time distributions for zone 2 $Z_2$ at a 20% duty cycle 164 and for zone 3 $Z_3$ at a 40% duty cycle 166. For both 20% and 40% duty cycles, there is no remainder, so the quotient is easily distributed over the 100 periods 164, 166. However, as shown from timing lines 168 and 170, each subsequent ON state 164, 166 is phase shifted from the previous in order to provide an even ON time distribution for each subperiod so that the main power supply can be derated as much as possible. As is evident from the example of FIG. 4, timing diagrams for the remaining zones would alternately phase shift the ON states to provide an even distribution of the ON states across the clock subperiods.

Accordingly, the present invention also includes a method of providing individual power control to multiple sections of an induction heating coil including the steps of tapping each section into a number of series connected zones within the induction heating coil and periodically or intermittently switching a current path around each of the zones such that the power and heat output of each zone is regulated, and the entire induction heating coil can provide even heat distribution to a workpiece. Each of the switchable current paths are in series with one another as well as the respective zones of the induction heating coil. In this manner, an induction heating coil need not be physically altered, but can be divided into as many sections as desired for providing consistent and even heat distribution.

The method of the present invention also includes sensing current in each power supply side of each zone, and detecting faults, such as overvoltage, and interrupting or causing switching in response to a fault detection. The system also optimizes distribution of ON times to reduce overall output requirements of the main power supply.

The present invention has been described in terms of the preferred embodiment, and it is recognized that equivalents, alternatives, and modifications, aside from those expressly stated, are possible and within the scope of the appending claims.

What is claimed is:

1. A power supply switching network to provide selective power control to multiple zones of an induction heating coil comprising:

a plurality of bidirectional switches, each bidirectional switch connectable in parallel with a portion of an induction heating coil, thereby defining a plurality of series connected induction heating coil zones;

a processor connected to the plurality of bidirectional switches to supply control signals thereto, the control signals creating a duty cycle for each bidirectional switch thereby regulating power to each induction heating coil zone; and wherein the power supply switching network is connectable between a single power supply and an induction heating coil to provide selective heat output from each of the induction heating coil zones.

2. The power supply switching network of claim 1 wherein each of the plurality of bidirectional switches are connected in series.

3. The power supply switching network of claim 1 further comprising a power factor correction bank of capacitors connected in parallel with the power supply and the induction heating coil.

4. The power supply switching network of claim 1 further comprising an inductor connected in series with the power supply and the induction coil.

5. The power supply switching network of claim 1 further comprising a power storage section having a bank of capacitors connected in parallel with the power supply and the induction heating coil, and an inductor connected in series with the power supply and the induction heating coil.

6. The power supply switching network of claim 1 wherein each bidirectional switch comprises a pair of series connected transistors connected in parallel with an induction heating coil zone.

7. The power supply switching network of claim 6 wherein each transistor has an associated diode connected in parallel therewith for current flow in an opposite direction from that through an associated transistor.

8. The power supply switching network of claim 6 wherein each transistor is an IGBT.

9. The power supply switching network of claim 1 further comprising a fiber optic driver connected between the processor and the plurality of bidirectional switches, and fiber optic connections between the fiber optic driver and the bidirectional switches.

10. The power supply switching network of claim 1 further comprising multi-zone feedback in operative association with a power supply connection of each induction heating coil zone to sense a fault condition and interrupt the processor in response thereto to cause switching of a given bidirectional switch.

11. The power supply switching network of claim 10 further comprising a plurality of current sensors for the operative association of the multi-zone feedback with the power supply side of each induction heating coil.

12. The power supply switching network of claim 9 further comprising multi-zone feedback circuitry connectable to each power supply feed of each induction heating coil zone with a plurality of current sensors, and connected to the fiber optic driver to interrupt same in response to the multi-zone feedback circuitry sensing a fault in a power supply feed.

13. The power supply switching network of claim 12 wherein the multi-zone feedback circuitry provides overvoltage protection.

14. The power supply switching network of claim 1 adapted for use in a heating system having an induction heating coil split in at least two defined sections, each defined having a power supply switching network connected thereto such that the processor individually controls each induction heating coil zone in each defined section independently to provide desired heating to a workpiece, thereby compensating for variable coil characteristics in any given zone.

15. A power supply switching network for creating a multi-zone induction heating coil and providing selective power control to each zone of the multi-zone induction heating coil comprising:

at least two series connected current switching devices connectable across an induction heating coil creating at least two series connected zones in the induction heating coil; and a processing unit creating and supplying a duty cycle controlling signal to each current switching device for regulating heat output from each zone in the induction heating coil.

16. The power supply switching network of claim 15 wherein the processor is programmed to receive temperature input signals indicative of a temperature in an induction heating coil zone, and normalizing the temperature input signals over a predefined range.

17. The power supply switching network of claim 16 wherein the processor is further programmed to distribute ON switching times of the switching devices over the entire predefined range.

18. The power supply switching network of claim 17 wherein the processor is further programmed to calculate a quotient and a remainder for each normalized signal to create a duty cycle, and evenly distribute the quotient as ON-time signals over the entire predefined range, and periodically add the remainder to selective ON-time signals.

19. The power supply switching network of claim 18 wherein the processor is further programmed to create subsections within the predefined range and to stagger the ON-time signals for each zone such that power supply to each zone is asynchronous at any given instant in time to thereby reduce power supply requirements.

20. The power supply switching network of claim 15 further comprising a power storage unit having at least one inductor sized to provide a constant current to each active zone of the multi-zone induction heating coil.

21. The power supply switching network of claim 20 wherein the power storage unit further comprises a capacitor bank for correcting a power factor and maintaining a consistent operating frequency.

22. The power supply switching network of claim 15 further comprising multi-zone feedback for sensing overvoltage conditions.

23. The power supply switching network of claim 22 wherein the multi-zone feedback comprises a plurality of current sensors sensing current to each zone of the induction heating coil.

24. The power supply switching network of claim 15 wherein each bidirectional switch comprises a pair of series connected transistors connected in parallel with an induction coil zone.

25. The power supply switching network of claim 24 wherein each transistor has an associated diode connected in parallel therewith and wherein each transistor is an IGBT.

26. The power supply switching network of claim 15 further comprising a fiber optic driver connected between the processor and the plurality of bidirectional switches, and fiber optic connections between the fiber optic driver and the bidirectional switches.

27. An induction heating apparatus for providing controlled heat distribution to a workpiece with a multi-zone tapped induction heating coil, the apparatus comprising:

an induction heating coil divided into at least two sections, each section connected in parallel with a power supply;

at least two switching networks, each switching network connected to a respective section of the induction heating coil and having a plurality of series connected bidirectional switches therein, each bidirectional switch connected in parallel with a portion of a respective section thereby dividing that section into individual series connected zones that are individually controllable; and a processor connected to each of the switching networks to selectively switch each bidirectional switch between an on-state and an off-state to thereby control power to each individual zone and provide controlled heat distribution within the induction heating coil.

28. The induction heating apparatus of claim 27 further comprising a power storage section having a bank of capacitors connected in parallel with the power supply and an inductor connected in series with the power supply and the induction coil.

29. The induction heating apparatus of claim 27 further comprising wherein each bidirectional switch comprises a pair of series connected transistors connected in parallel with an induction heating coil zone.

30. The induction heating apparatus of claim 29 wherein each transistor has an associated diode connected in parallel therewith, and wherein each transistor is an IGBT.

31. The induction heating apparatus of claim 27 further comprising a fiber optic driver connected between the processor and the plurality of bidirectional switches, and fiber optic connections between the fiber optic driver and the bidirectional switches.

32. The induction heating apparatus of claim 31 further comprising multi-zone feedback circuitry connectable to each power supply feed of each induction heating coil zone with a plurality of current sensors, and connected to the fiber optic driver to interrupt same in response to the multi-zone feedback circuitry sensing a fault in a power supply feed.

33. The power supply switching network of claim 27 wherein the processor is programmed to receive temperature input signals indicative of a temperature in an induction heating coil zone, and normalizing the temperature input signals over a predefined range.

34. The power supply switching network of claim 33 wherein the processor is further programmed to distribute ON switching times of the switching devices over the entire predefined range.

35. The power supply switching network of claim 34 wherein the processor is further programmed to calculate a quotient and a remainder for each normalized signal to create a duty cycle, and evenly distribute the quotient as ON-time signals over the entire predefined range, and periodically add the remainder to selective ON-time signals.

36. The power supply switching network of claim 35 wherein the processor is further programmed to create subsections within the predefined range and to stagger the ON-time signals for each zone such that power supply to each zone is asynchronous at any given instant in time to thereby reduce power supply requirements.

37. A method of providing individual power control to multiple sections of an induction heating coil comprising the steps of:

tapping each section of an induction heating coil into respective series connected zones;

providing a parallel current path with each series connected zone;

connecting each current path in series with one another; and intermittently switching the parallel current paths around each of the series connected zones such that power and heat output to each zone are controllable.

38. The method of claim 37 further comprising the steps of receiving temperature input signals indicative of a temperature in an induction heating coil zone, and normalizing the temperature input signals over a predefined range.

39. The method of claim 38 further comprising the steps of distributing ON switching times of the switching devices over the entire predefined range.

40. The method of claim 39 further comprising the steps of calculating a quotient and a remainder for each normalized signal to create a duty cycle, and evenly distributing the quotient as ON-time over the entire predefined range, and periodically adding the remainder to selective ON-time signals.

41. The method of claim 40 further comprising the steps of creating subsections within the predefined range and to stagger the ON-time signals for each zone such that power to each zone is asynchronous at any given instant in time to thereby reduce power supply requirements.

42. The method of claim 37 further comprising the steps of sensing a current in each power supply side of each zone detecting faults therein, and interrupting switching cycles in response to a fault detection.

* * * * *

UNITED STATES PATENT AND TRADEMARK OFFICE

CERTIFICATE OF CORRECTION

PATENT NO. : 6,078,033

DATED : June 20, 2000

INVENTOR(S) : Bowers, Thomas J., et al.

It is certified that error appears in the above-indentified patent and that said Letters Patent is hereby corrected as shown below:

Front page, first column [56] References Cited U.S. PATENT DOCUMENTS Add the following U.S. Patent References

| | | | |
|---|---|---|---|
| 5,684,686 | 11/97 | Reddy et al. | 363/97 |
| 5,079,399 | 01/92 | Itoh et al. | 219/662 |
| 5,666,377 | 09/97 | Havas et al. | 373/147 |
| 5,541,498 | 07/96 | Beckwith et al. | 323/211 |
| 5,571,438 | 11/96 | Izaki et al. | 219/625 |
| 5,450,305 | 09/95 | Boys et al. | 363/24 |

Column 10, line 59: Insert --supply-- after "power".

Signed and Sealed this

Third Day of April, 2001

*Attest:*

Nicholas P. Godici

NICHOLAS P. GODICI

*Attesting Officer*

*Acting Director of the United States Patent and Trademark Office*